United States Patent [19]

Bullard et al.

[11] Patent Number: 5,044,774

[45] Date of Patent: Sep. 3, 1991

[54] HOLD-OPEN BAG TOP

[75] Inventors: Edward M. Bullard, East Rochester, N.Y.; Stephen K. Guerrera, Milford, Mass.; Fox J. Herrington, Holcomb; Ivy Wolpin, Rochester, both of N.Y.

[73] Assignee: Mobil Oil Corporation, Fairfax, Va.

[21] Appl. No.: 599,268

[22] Filed: Oct. 16, 1990

Related U.S. Application Data

[63] Continuation of Ser. No. 375,173, Jul. 3, 1989, abandoned.

[51] Int. Cl.[5] ..... B65D 33/02

[52] U.S. Cl. ..... 383/34.1; 383/33

[58] Field of Search ..... 383/33, 34, 34.1, 43, 383/63; 493/215, 923, 924, 962, 963; 220/403; 150/900

[56] References Cited

U.S. PATENT DOCUMENTS

| | | | |
|---|---|---|---|
| 2,093,976 | 9/1937 | Farmer | 383/43 X |
| 2,873,905 | 2/1959 | Denton | 383/33 X |
| 3,000,415 | 9/1961 | Kritschever | 383/78 |
| 3,141,601 | 7/1964 | Ayres et al. | 383/78 |
| 3,147,903 | 9/1964 | Lipschutz et al. | 220/403 |
| 3,272,248 | 9/1966 | O'Farrell | 383/43 |
| 3,280,870 | 10/1966 | Bundy | 383/63 X |
| 3,346,883 | 10/1967 | Ersek | 383/33 X |
| 3,406,853 | 10/1968 | McLeod | 383/33 X |
| 3,474,725 | 10/1969 | Wiehahn | 383/78 |
| 4,691,373 | 9/1987 | Ausnit | 383/63 |
| 4,756,628 | 7/1988 | Branson | 383/63 |
| 4,898,477 | 2/1990 | Cox et al. | 383/33 |

FOREIGN PATENT DOCUMENTS

| | | | |
|---|---|---|---|
| 637845 | 4/1962 | Italy | 383/34 |
| 386919 | 4/1965 | Switzerland | 383/65 |
| 1253884 | 2/1986 | U.S.S.R. | 383/33 |
| 8702968 | 5/1987 | World Int. Prop. O. | 383/65 |

*Primary Examiner*—Stephen Marcus
*Assistant Examiner*—Jes F. Pascua
*Attorney, Agent, or Firm*—Alexander J. McKillop; Charles J. Speciale

[57] ABSTRACT

A thermoplastic bag having a flexible top has a stiff strip around the mouth of the bag which when rolled outward bends to hold open the bag.

5 Claims, 1 Drawing Sheet

HOLD-OPEN BAG TOP

This is a continuation of application Ser. No. 375,173, filed July 3, 1989, now abandoned.

FIELD OF THE INVENTION

The present invention relates to flexible wall bags having a flexible top and particularly to thermoplastic bags in which the tops are flexible and difficult to hold open for loading.

BACKGROUND OF THE INVENTION

Bags made of thin polyethylene material have been used in various sizes. Small bags are used in packaging of sandwiches and the like, medium size bags are used for garbage and kitchen trash and larger bags are used for other types of trash such as lawn clippings and leaves. Bags of this type generally include a front wall and back wall and are seamed up the sides with an open top. The top is adapted to be closed by twisting and maintained closed by a suitable tie strip or string. The present invention is particularly concerned with thermoplastic bags of this type. Since thermoplastic bags are made of very thin material they are difficult to handle when inserting trash such as leaves and grass clippings. To aid in holding open the tops of such bags various types of frames have been used to support the bag while it is being loaded. Many times the user does not have one of these frames available and thus it is necessary for the user to hold open the top of the bag as best he can while loading it with the leaves or other items.

It is desirable to produce a thermoplastic bag having a hold-open top to permit ease in loading of the bag.

SUMMARY OF THE INVENTION

In accordance with the present invention there is provided a thermoplastic bag having a hold-open top comprising two panels forming an open top, closed bottom bag, the panels being joined along the sides of the bag. The bag is provided with a pair of narrow strips of stiff material extending along the open top of the bag, one of the strips being attached to the outer surface of one of the panels, the other of the strips being attached to the outer surface of the other of the panels and both of the strips being attached to each other in face-to-face relation at the respective ends thereof. The pair of strips have the characteristic of being flexible throughout their length whereby when the top of the bag is rolled outward, the pair of attached strips bend and turn inside out so as to hold open the mouth of the bag. In accordance with another aspect of the invention the pair of strips have hinge structure intermediate the ends thereof to permit folding of the bag at the hinge structure for packaging. To further facilitate packaging the strips have hinge structure at one-third points across the length to divide the strips into a center section and two end sections to permit folding of the bag for packaging by folding the end sections over against the center section. In accordance with a preferred form of the invention, the strips of stiff material are made of plastic material such for example as polystyrene.

The foregoing and other objects, features and advantages of the invention will be more apparent from the following detailed description and appended claims.

SHORT DESCRIPTION OF THE DRAWINGS

DESCRIPTION OF THE PREFERRED EMBODIMENT

Figure 1:
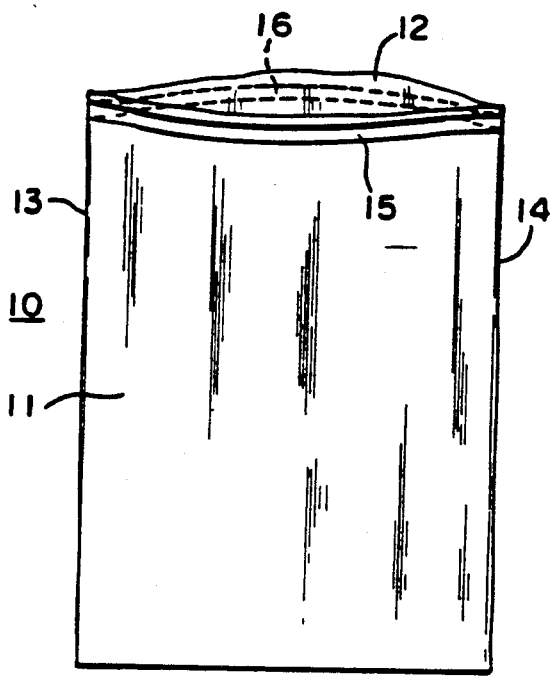
FIG. 1 shows a thermoplastic bag having a hold-open top embodying the present invention.
Figure 2:
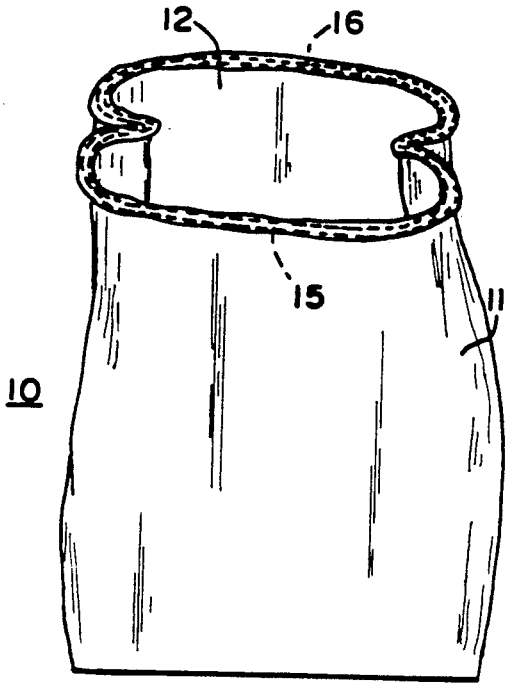
FIG. 2 is a perspective view of the bag shown in FIG. 1 with the hold-open top rolled down to maintain the top in open position.
Figure 3:
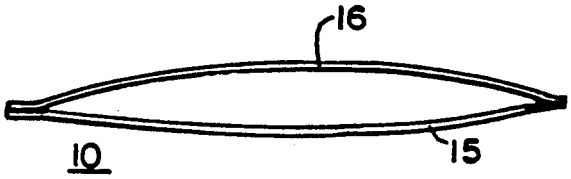
FIG. 3 is a top view of the bag shown in FIG. 1.
Figure 4:
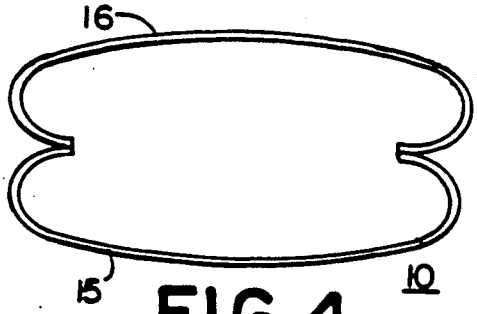
FIG. 4 is a top view of the bag shown in FIG. 2.

As shown in FIG. 1, the thermoplastic bag 10 for carrying trash or the like includes a front panel 11 and a rear panel 12. The two panels are formed from an extruded tube of polyethylene or other suitable plastic material which is slit along the side to form an open top. The sides of the panel 11 and 12 are heat sealed at 13 and 14 and cut from the tube in a perpendicular direction. As thus far described, bags of this type are well known in the art. As may be seen in FIG. 1 the pair of narrow strips of stiff material 15 and 16 extend along the open top of the bag 10 and have a length corresponding substantially to the width of the bag. The strip 15 is attached to the outer surface of the front panel 11 and the strip 16 is attached to the outer surface of the rear panel 12 and both of the strips 15 and 16 are attached to each other in face-to face relation at the respective ends thereof. The attachment of the pair of strips 15, 16 to the respective panels 11, 12 of the bag and to each other may be accomplished in any suitable manner such as by heat sealing or by a suitable adhesive. The type of sealing employed will depend upon the material from which the stiff strips are made. While the material from which the strips are made is not critical, the strips which are substantially rectangular in cross-section should have the characteristic of being flexible throughout their length and a width to thickness ratio whereby when the top of the bag is rolled outward, the pair of attached strips bend and turn inside out so as to hold open the mouth of the bag as shown in FIGS. 2 and 4. One example of a suitable thermoplastic material is polystyrene. Strips of polystyrene having a thickness of approximately 10 to 60 mils and a width in the order of ¼ to ½ inch will provide a satisfactory hold-open bag top. Other strip materials that can be used are polyethylene and polypropylene and these materials have the advantage that they can be chopped up and reclaimed along with the bag in the event any of the bags are defective during manufacture. Another example of suitable stiff strip material is polyvinylchloride—non-plasticized rigid PVC. Another example is polyester although it is expensive. In order to minimize the thickness of the strip material it can be provided with ribs to provide additional stiffness rather than plain surfaced strip material. It will be noted that the ends of the strip are attached to each other in face-to-face relation rather than being hinged to each other. This insures that when the strips and the top of the bag are turned inside out as shown in FIGS. 2 and 4 the ends of the strips 15 and 16 assume the position shown in FIGS. 2 and 4 rather than assuming a position similar to FIG. 3.

Figure 5:
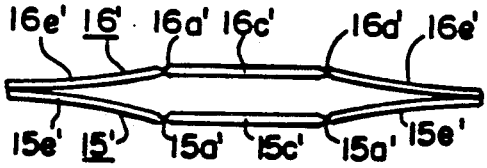
FIG. 5 is a top view of a thermoplastic bag having a hold-open top employing a modification of the invention.
Figure 6:
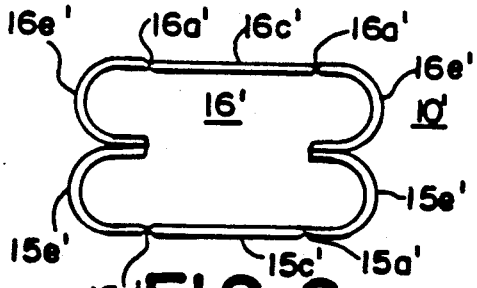
FIG. 6 is a top view of the bag shown in FIG. 5 with the top rolled down to maintain the top of the bag in open position similar to FIG. 2.
Figure 7:
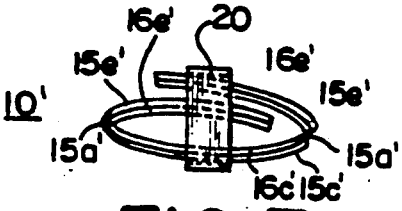
FIG. 7 is a top view of the bag illustrated in FIG. 5 with the sections of the hold-open top folded against each other for packaging.

Referring to FIGS. 5–7 there is illustrated a modification of the present invention. As may be seen in FIG. 5 the thermoplastic bag 10 is provided with a pair of narrow strips of stiff material 15' and 16' which are attached to the front and back panels of the bag 10, and to each other in face-to-face relation at the ends thereof in the manner similar to that previously described in connection with FIGS. 1 and 3. The strips 15' and 16' have hinge structure 15*a'*, 16*a'* at one-third points across the length of each strip to divide the strips into a center section 15*c'* and 16*c'* and two end sections 15*e'* and 16*e'* to permit folding of the bag 10' for packaging by folding the end sections over against the center section. When the top of the bag 10' is rolled outward and down from the position shown in FIG. 5 to the position shown in FIG. 6 the pair of hinged strips 15' and 16' take the position shown in FIG. 6 and bend and turn inside out so as to hold open the mouth of the bag 10'. After the bag 10' has been filled with the grass clippings or other material, the top of the bag is unrolled and returned to the original position shown in FIG. 5. The top of the bag may then be secured closed in any suitable manner ready for disposal of the filled bag.

The embodiment illustrated in FIGS. 5–7 has the additional advantage of being easily packaged for shipment. Since the stiff strips 15' and 16' have hinge structure 15*a'*, 16*a'* at the one-third points across the length of the strips, the two end sections 15*e'* and 16*e'* can be folded over the center section 15*c'* and 16*c'* as shown in FIG. 7. These sections may then be held together by means of a clip 20. This construction provides for ease in folding of the bag for packaging and sale to customers.

When the strips 15' and 16' are made of thermoplastic material, the hinge structure 15*a'* and 16*a'* may be formed by thin sections of the strips. This construction is known in the thermoplastic art as a "living hinge".

What is claimed is:

1. A thermoplastic bag having a hold-open top comprising two panels forming an open top, closed bottom bag, said panels being joined along the sides of said bag, and a pair of narrow strips of stiff material extending along the open top of said bag, one of said strips being attached to a surface of one of said panels, the other of said strips being attached to a surface of the other of said panels and both of said strips being attached to each other in face-to-face relation at the respective ends thereof, said pair of strips having the characteristic of being flexible throughout their length and a width to thickness ratio whereby when the top of the bag is rolled outward, the pair of attached strips bend and turn inside out so as to hold open the mouth of the bag; each of said strips having hinge structure intermediate the ends thereof at one-third points across its length to divide said strips into a center section and two end sections to permit folding of the bag for packing by folding the end sections over against the center section.

2. A thermoplastic bag according to claim 1 wherein said pair of strips are thermoplastic material.

3. A thermoplastic bag according to claim 1 including clip means for holding the sections of the bag in folded position for packaging.

4. The method of holding open the top of a thermoplastic bag, the bag comprising two thermoplastic panels forming an open top, closed bottom bag, the panels being joined along the sides of the bag and a pair of narrow strips of stiff material extending along the open top of the bag, one of the strips being attached to the outer surface of one of the panels, the other of the strips being attached to the outer surface of the other panels and both of the strips being attached to each other in face-to-face relation at the respective ends thereof, the pair of strips having a characteristic of being flexible throughout their length, said method comprising the steps of rolling outward and downward the top of the bag and the pair of attached strips so that the panels at the top of the bag enclose the pair of strips and the strips bend and turn inside out so as to hold open the mouth of the bag.

5. The method of holding open the top of a thermoplastic bag, the bag comprising two thermoplastic panels forming an open top, closed bottom bag, the panels being joined along the sides of the bag and a pair of narrow strips of stiff material extending along the open top of the bag, one of the strips being attached to a surface of one of the panels, the other of the strips being attached to a surface of the other panels and both of the strips being attached to each other in face-to-face relation at the respective ends thereof, the pair of strips having a characteristic of being flexible throughout their length, said method comprising the steps of rolling outward and downward the top of the bag and the pair of attached strips so that the strips bend and turn inside out so as to hold open the mouth of the bag.

* * * * *